US009107257B2

(12) United States Patent
Jayabalan et al.

(10) Patent No.: US 9,107,257 B2
(45) Date of Patent: Aug. 11, 2015

(54) ADAPTIVE FREQUENCY CONTROL TO CHANGE A LIGHT OUTPUT LEVEL

(75) Inventors: Ranjit Jayabalan, Danvers, MA (US); Nagaraja Chikkegowda, North Andover, MA (US); Christian Breuer, Newburyport, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 1032 days.

(21) Appl. No.: 13/033,644

(22) Filed: Feb. 24, 2011

(65) Prior Publication Data

US 2012/0217889 A1 Aug. 30, 2012

(51) Int. Cl.
*H05B 39/02* (2006.01)
*H05B 33/08* (2006.01)

(52) U.S. Cl.
CPC ..... *H05B 33/0815* (2013.01); *H05B 33/0848* (2013.01)

(58) Field of Classification Search
USPC ..... 315/209 R, 185 R, 186, 192, 193, 210, 315/224, 291, 297, 299, 300, 307, 308, 312, 315/362
See application file for complete search history.

(56) References Cited

U.S. PATENT DOCUMENTS

| | | | |
|---|---|---|---|
| 7,088,059 | B2 | 8/2006 | McKinney et al. |
| 7,215,104 | B2 | 5/2007 | Nakata |
| 7,321,203 | B2 | 1/2008 | Marosek |
| 7,368,977 | B2 | 5/2008 | Wei et al. |
| 7,535,183 | B2 | 5/2009 | Gurr |
| 2004/0251854 | A1 | 12/2004 | Matsuda et al. |
| 2006/0138973 | A1 | 6/2006 | Hirosawa |
| 2007/0210725 | A1 | 9/2007 | Marosek |
| 2010/0259177 | A1 | 10/2010 | Mednik |
| 2010/0277088 | A1 | 11/2010 | Bodano |

OTHER PUBLICATIONS

Gabriele Benedetti, International Search Report and Written Opinion of the International Searching Authority, Jul. 25, 2012, pp. 1-9, European Patent Office, Rijswijk, The Netherlands.

*Primary Examiner* — Douglas W Owens
*Assistant Examiner* — Jianzi Chen
(74) *Attorney, Agent, or Firm* — Shaun P. Montana

(57) ABSTRACT

Systems and methods to change a light output level using adaptive frequency control are provided. A switched mode power converter is configured to switch output current to a light emitting diode (LED) module, which includes an LED lighting element, at a switching frequency. Control circuitry is configured to receive a dimming control input that corresponding to a desired light output level of the LED module. The control circuitry is also configured to provide a pulse width modulation (PWM) output configured to pulse width modulate the output current, the PWM output having a pulse width, a PWM frequency, and a PWM period corresponding to the PWM frequency. The control circuitry is also configured to adjust at least one of the PWM period and the switching period in response to a change in the dimming control input, such that a light output level of the LED module is appropriately changed.

17 Claims, 8 Drawing Sheets

ADAPTIVE FREQUENCY CONTROL TO CHANGE A LIGHT OUTPUT LEVEL

TECHNICAL FIELD

The present disclosure relates to lighting and, more particularly, to dimming solid state light sources.

BACKGROUND

Typically, solid state light sources, such as but not limited to light emitting diodes (LEDs), are dimmed using pulse width modulation (PWM). When dimming at low light levels, such as below 15% of the total light output, the light output of an LED may not always be stable. The effects of such unstable output may be so significantly prominent as to be perceivable to a human eye, whether during fading down or transitioning up to a light output of about 0 to 15% of the total light output.

In addition, at relatively slow rates of change, unstable output may creep in during changes between different light levels that are greater than 15% of the total light output from the LED. Here, such unstable output may be due to a relatively large granular step size of the power converter/LED driver compared to the PWM dimming signal.

SUMMARY

Embodiment described herein adapt a switching frequency of a switching power converter and/or a frequency of a PWM (pulse width modulation) dimming signal to inhibit (e.g. reduce, minimize or eliminate) instability in light output at relatively low light output levels and/or a relatively low rate of change of a dimming control input. For example, instability in light output may be inhibited when a pulse width of the PWM dimming signal is a whole number multiple of a switching period of the switching power converter and/or the PWM dimming signal is synchronized with the switching of the switching power converter. Embodiments may adjust at least one of a period of the PWM dimming signal and a switching period (corresponding to the switching frequency) of the power converter. The period(s) may be adjusted in response to a change in the dimming control input and/or when the light output level is relatively low, e.g., less than 20% of maximum light output.

For example, in some embodiments, the switching frequency may be increased so that the PWM pulse width corresponds to an integral multiple (i.e., whole number multiple) of a resulting switching period. In other embodiments, the switching frequency may be increased so that the resulting switching period corresponds to a minimum nonzero pulse width of the PWM dimming input. In other embodiments, the switching frequency may be increased so that the resulting switching period corresponds to a minimum delta (i.e., change) in pulse width of the PWM dimming input. In other embodiments, the frequency of the PWM dimming signal may be decreased (thereby increasing the PWM dimming signal period). To achieve a light output level corresponding to the dimming control input, the pulse width may be maintained and a resulting duty cycle (i.e., ratio of ON time (i.e., pulse width) to PWM period) may then correspond to the dimming control input. For example, the frequency of the PWM dimming signal may be decreased while maintaining the pulse width as an integral multiple of the switching period. The switching of the power converter may be synchronized with the PWM pulse so that a start of a cycle of the PWM signal corresponds to a start of a cycle of the switching of the power converter.

LED drivers typically include direct current (DC) power supplies, which may use switch mode power conversion technology (e.g., a "switching converter") rather than a linear drive method for increased efficiency. Switching converters may receive a DC input voltage and convert the received DC input voltage to a DC output voltage different from the DC input voltage. Switching power converters may operate at relatively high switching frequencies, e.g., on the order of 80 kHz to deliver a constant current at the DC output voltage. For example, a DC input voltage of 450 VDC may be converted to a DC output voltage of 107 VDC with a constant output current of 350 mA.

Dimming an LED light source may be accomplished by pulse width modulating the current supplied to the LED light source by, e.g., the switching power converter. The duty cycle (i.e., the ratio of the pulse width to the PWM period) of the PWM current is varied in order to change the light output. For example, the PWM dimming frequency may be on the order of 200 Hz or higher. Under dimming, the operation of the switching power converter may be interrupted at the PWM dimming frequency, e.g., 200 Hz. As a result, the output current appears as a relatively high frequency signal (e.g., 80 kHz) on a relatively low frequency dimming signal (e.g., 200 Hz).

When a PWM dimming signal interrupts an operation of the switching converter in the middle of the switching converter's high frequency switching cycle, the operation of the switching converter may not be terminated immediately. For example, the switching converter may wait until an end of its switching cycle to reduce its output current. Depending on the ON time (i.e., pulse width) of the PWM dimming signal (200 Hz), the switching converter may terminate its cycle on the $n^{th}$ cycle or $n+1^{th}$ cycle. For example, the switching of some switching power converters is controlled such that switching may not be halted mid-cycle. At low dim levels of less than, e.g., 15%, this may cause unstable light output, which may be more perceivable than at a higher light output, e.g., of greater than 15%.

During a transition between two relatively low light levels, unstable light output may be perceptible by a human eye. During the transition, as the ON time (pulse width) of the PWM dimming signal changes in relatively small steps, there can be multiple cycles of the PWM dimming signal where the ON to OFF transition of the PWM pulse falls within the $n^{th}$ converter cycle resulting in no light output change (e.g., because the converter completes the switching cycle).

In an embodiment, there is provided a light output control apparatus. The light control apparatus includes: a switched mode power converter configured to switch output current to a light emitting diode (LED) module at a switching frequency, the switching frequency having a corresponding switching period, the LED module comprising at least one LED lighting element; and control circuitry, wherein the control circuitry is configured to receive a dimming control input, the dimming control input corresponding to a desired light output level of the LED module, to provide a pulse width modulation (PWM) output configured to pulse width modulate the output current, wherein the PWM output has a pulse width, a PWM frequency, and a PWM period corresponding to the PWM frequency, and to adjust at least one of the PWM period and the switching period in response to a change in the dimming control input, such that a light output level of the LED module is appropriately changed.

In a related embodiment, the control circuitry may be further configured to increase the switching frequency in response to the change in the dimming control input. In a further related embodiment, a maximum switching frequency may correspond to a minimum PWM pulse width. In another related embodiment, the control circuitry may be further configured to increase the PWM period in response to the dimming control input. In yet another related embodiment, the control circuitry may be further configured to synchronize the PWM output and the switching of the power converter. In still another related embodiment, the control circuitry may be further configured to adjust the at least one of the PWM period and the switching period when the desired light output level is below a threshold. In yet still another related embodiment, the control circuitry may be further configured to adjust the at least one of the PWM period and the switching period so that the PWM pulse width is an integral multiple of the switching period.

In another embodiment, there is provided a system. The system includes: a light emitting diode (LED) module comprising at least one LED lighting element; a switched mode power converter configured to switch output current to the LED module at a switching frequency, the switching frequency having a corresponding switching period; and control circuitry configured to receive a dimming control input corresponding to a desired light output level of the LED module, to provide a pulse width modulation (PWM) output configured to pulse width modulate the output current, wherein the PWM output has a pulse width, a PWM frequency and a PWM period corresponding to the PWM frequency, and to adjust at least one of the PWM period and the switching period in response to a change in the dimming control input.

In a related embodiment, the control circuitry may be further configured to increase the switching frequency in response to the change in the dimming control input. In a further related embodiment, a maximum switching frequency may correspond to a minimum PWM pulse width. In another further related embodiment, the control circuitry may be further configured to adjust the at least one of the PWM period and the switching period so that the PWM pulse width is an integral multiple of the switching period.

In another related embodiment, the control circuitry may be further configured to increase the PWM period in response to the dimming control input. In still another related embodiment, the control circuitry may be further configured to synchronize the PWM output and the switching of the power converter. In yet another further related embodiment, the control circuitry may be further configured to adjust the at least one of the PWM period and the switching period when the desired light output level is below a threshold.

In another embodiment, there is provided a method of changing a light output level of a light emitting diode (LED) module. The method includes: switching an output current to the LED module at a switching frequency, the switching frequency having a corresponding switching period; receiving a dimming control input corresponding to a desired light output level of the LED module; providing a pulse width modulation (PWM) output configured to pulse width modulate the output current, wherein the PWM output has a pulse width, a PWM frequency and a PWM period corresponding to the PWM frequency; and adjusting at least one of the PWM period and the switching period in response to a change in the dimming control input, such that the light output level of the LED module is appropriately changed.

In a related embodiment, adjusting may include increasing the switching frequency in response to the change in the dimming control input. In a further related embodiment, providing may include: providing a pulse width modulation (PWM) output configured to pulse width modulate the output current, wherein the PWM output has a pulse width, a PWM frequency and a PWM period corresponding to the PWM frequency, and wherein a maximum switching frequency corresponds to a minimum PWM pulse width.

In another related embodiment, adjusting may include: increasing the PWM period in response to the dimming control input. In yet another related embodiment, the method may further include: synchronizing the PWM output and the switching of a power converter connected to the LED module. In still another related embodiment, the method may further include: determining that the desired light output level is below a threshold; and in response, adjusting at least one of the PWM period and the switching period.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

The term "dimming", as used herein, refers to both reducing and/or increasing a light output level of a light source, such as but not limited to a solid state light source (e.g., an LED). Thus, "changing" may be used in place of "dimming" throughout without departing from the scope of embodiments described herein.

Figure 1A:
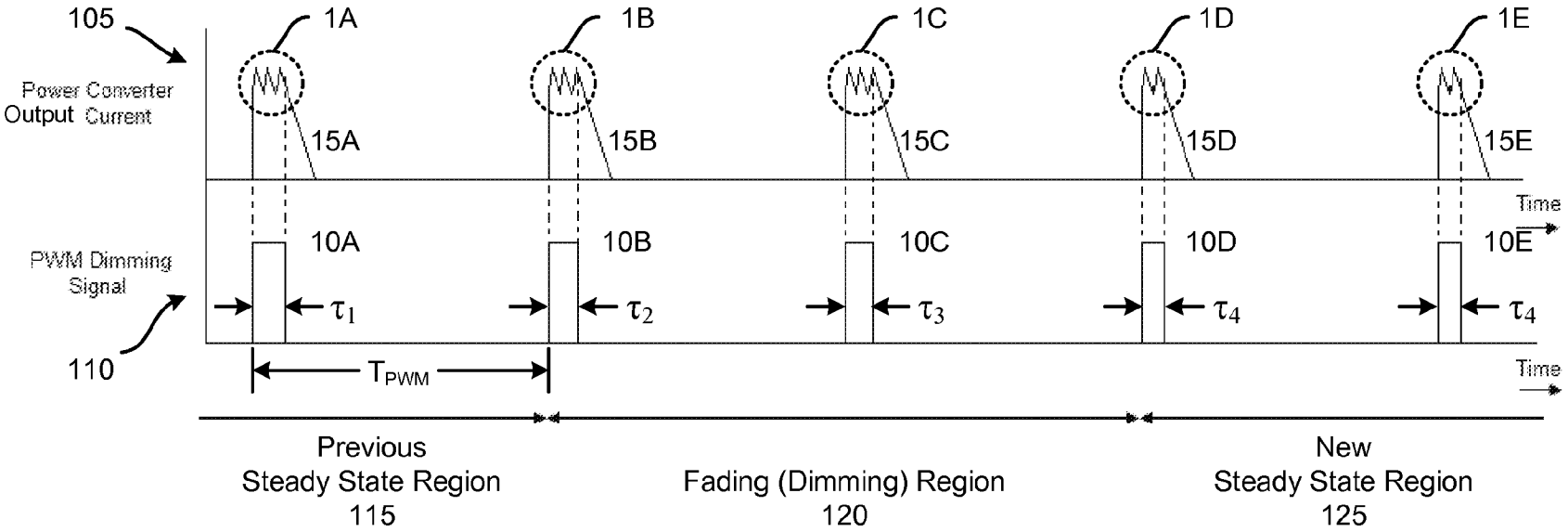
FIG. 1 shows a schematic drawing of a representative waveform of output current without adaptive frequency control and which may be understood to cause unstable light output.
FIG. 1B shows a schematic drawing of another representative waveform of output current, particularly at a very low steady state light output, without adaptive frequency control and which may be understood to cause unstable light output.

FIG. 1A shows plots of a switching power converter output current waveform 105 and a PWM dimming signal 110, for a system without adaptive frequency control. The plots are simplified and are meant for illustration only. FIG. 1A includes three regions: a previous steady state region 115, a fading (dimming) region 120, and a new steady state region 125. The previous steady state region 115 corresponds to, e.g., an initial light output level of a solid state light source, such as but not limited to one or more LEDs, which may or may not be part of an LED module. In the previous steady state region 115, a light output level may be generally constant, and thus a dimming input signal is not changing in the previous steady state region 115. In the fading (dimming) region 120, the dimming input signal is changing corresponding to a change in a desired light output level of, e.g., an LED module. In the new steady state region 125, a light output level may be generally constant and corresponds to the desired output level of the LED module. In other words, the new steady state region 125 corresponds to a final light output level.

The PWM dimming signal 110 is shown in FIG. 1A to include a series of PWM pulses 10A, 10B, 10C, 10D, 10E, each pulse at a PWM frequency ($f_{PWM}$) corresponding to a PWM period, $T_{PWM}$ (i.e., $f_{PWM}=1/T_{PWM}$). Each PWM pulse 10A, 10B, 10C, 10D, 10E has a corresponding pulse width, $\tau$ (i.e., ON time). The duty cycle of the PWM dimming signal 110 corresponds to the pulse width divided by the PWM period (i.e., $(\tau/T_{PWM})*100\%$). A duty cycle of 100% corresponds to "full-on", i.e., no dimming, and therefore a maximum light output level. A relatively low light output level corresponds to a duty cycle of less than 20%. For example, the PWM pulse 10A has a pulse width $\tau_1$, the PWM pulse 10B has a pulse width $\tau_2$, the PWM pulse 10C has a pulse width $\tau_3$, and the PWM pulses 10D and 10E have pulse widths $\tau_4$. In this example, $\tau_1$ is greater than $\tau_2$, $\tau_2$ is greater than $\tau_3$, and $\tau_3$ is greater than $\tau_4$. In other words, the light output level corresponding to $\tau_1$ is greater than the light output level corresponding to $\tau_2$, which is greater than the light output level corresponding to $\tau_3$ which is greater than the light output level corresponding to $\tau_4$. $\tau_1$ corresponds to an initial light output level prior to dimming and $\tau_4$ corresponds to a final light output level after dimming.

The power converter output current waveform 105 includes a series of output pulses 15A, 15B, 15C, 15D, 15E at the PWM frequency $f_{PWM}$. Each output pulse 15A, 15B, 15C, 15D, 15E includes a ripple, e.g., ripple 1A, 1B, 1C, 1D, 1E, respectively, at a frequency corresponding to the switching frequency ($f_{sw_nom}$) of the power converter. Each ripple 1A, 1B, 1C, 1D, 1E includes a whole number multiple of periods ($T_{sw_nom}$) at the switching frequency of the power converter. Accordingly, duration of the ripple of each output pulse is greater than or equal to a pulse width, $\tau$, of an associated PWM pulse, as described herein. For example, the duration of the ripple 1A of the output pulse 15A (in the previous steady state region 115) is substantially equal (i.e., within the tolerances of control circuitry) to the pulse width, $\tau_1$, of the associated PWM pulse 10A. The ripple 1A includes a whole number multiple, m, of switching periods, $T_{sw_nom}$, i.e., the duration of the ripple is $m*T_{sw_nom}$. Accordingly, $\tau_1$ is substantially equal to $m*T_{sw_nom}$.

In the fading (dimming) region 120, the duration of the ripples 1B and 1C may remain at $m*T_{sw_nom}$ and are greater than the ON times ($\tau_2$ and $\tau_3$) of their associated PWM pulses 10B and 10C. For example, the switching power converter may be configured to complete a switching cycle prior to shutting down its output current, in response to an ON to OFF transition (i.e., falling edge) of a PWM pulse, as described herein. In other words, when a PWM pulse width, $\tau$, is not equal to an integral multiple of switching periods of the switching converter, the duration of the ripple on an associated output pulse may be greater than the PWM pulse width. This may result in a perceptible flicker in the light output level of the LED or LED module. As an amount of dimming is changed, the light output level may change in a discrete rather than continuous manner.

In the new steady state region 125, the durations of the ripples 1D and 1E of the output pulses 15D and 15E may be substantially equal (i.e., within the tolerances of control circuitry) to the pulse width, $\tau_4$, of the associated PWM pulses 10D and 10E. The ripples 1D and 1E may include a whole number multiple, e.g., m−1, of switching periods, $T_{sw_nom}$ (i.e., the duration of the ripple is $(m-1)*T_{sw_nom}$). Accordingly, $\tau_4$ may be substantially equal to $(m-1)*T_{sw_nom}$. The PWM pulse width in the new steady state region 125 may be less than $(m-1)*T_{sw_nom}$, depending on the total amount of dimming. For example, the amount of dimming may correspond to a decrease in ripple duration on the order of tens or hundreds times the switching period, $T_{sw_nom}$. Here, (m−1) is shown merely for illustrative purposes, and is otherwise non-limiting.

Figure 1B:
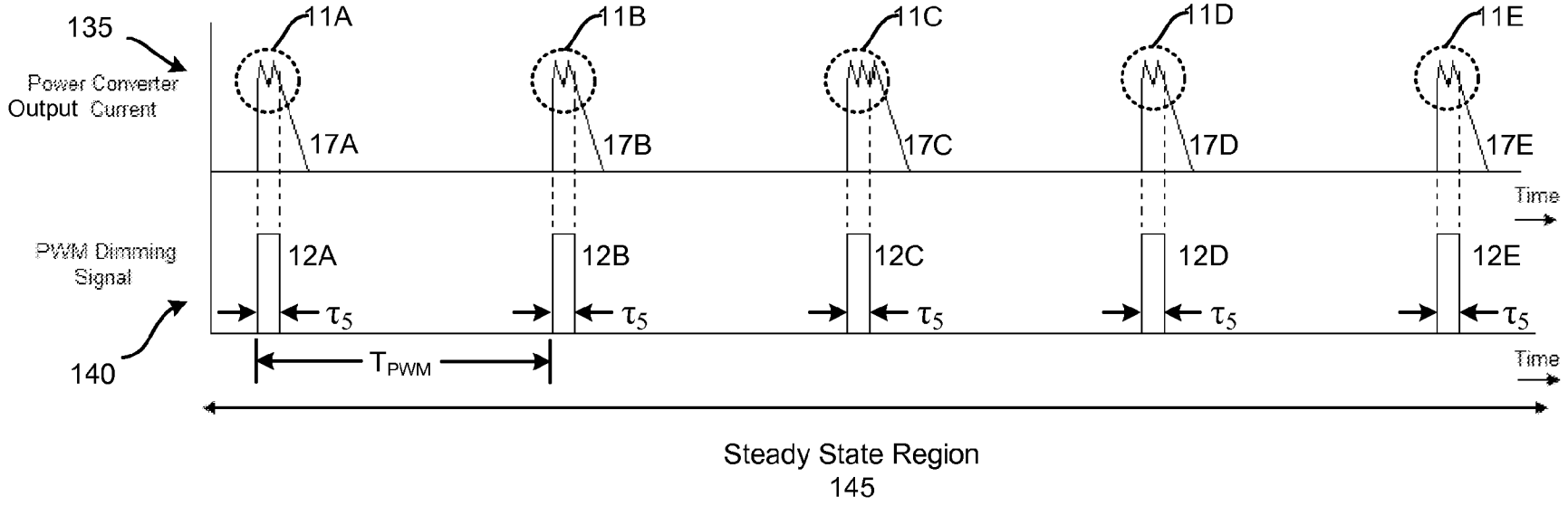

FIG. 1B shows plots of a switching power converter output current waveform 135 and a PWM dimming signal 140, for another system without adaptive frequency control. Similar to FIG. 1A, the plots are simplified and meant for illustration only. FIG. 1B includes one region: a steady state region 145. The steady state region 145 corresponds to a very low light output level that may be generally constant. The PWM dimming signal 140 is shown to include a series of PWM pulses 12A, 12B, 12C, 12D, 12E at the PWM frequency ($f_{PWM}$), corresponding to the PWM period $T_{PWM}$. Each PWM pulse 12A, 12B, 12C, 12D, 12E has a corresponding pulse width, $\tau_5$. The power converter output current waveform 135 includes a series of output pulses 17A, 17B, 17C, 17D, 17E at the PWM frequency $f_{PWM}$. Each output pulse includes a ripple 11A, 11B, 11C, 11D, 11E, respectively, at a frequency corresponding to the switching frequency ($f_{sw_nom}$) of the power converter. Each ripple 11A, 11B, 11C, 11D, 11E includes a whole number multiple of switching periods ($T_{sw_nom}$) at the switching frequency of the power converter. Accordingly, a duration of the ripple in each output pulse may be greater than or equal to the pulse width $\tau_5$ of an associated PWM pulse.

At very low light output levels (e.g., duty cycle≤3%), flicker in light output may be perceptible even at steady state, i.e., when a dimming level is not changing. When the PWM pulse transitions from high to low ("falling edge") near an end of a switching period of the power converter, the power converter may remain energized for an additional switching period. For example, a delay in the falling edge of the PWM pulse and/or a relatively early termination of a power converter switching period so that a next switching period begins before the PWM dimming signal is low may result in an additional switching period. Thus, the output pulse 17C may include an additional switching period relative to the output pulses 17A, 17B, 17D, 17E. This additional switching period may occur for one or more PWM dimming cycles and may result in oscillation and/or unstable light output, particularly at very low light output levels. Although this oscillation and/or unstable light output may also occur at relatively high light output levels (e.g., duty cycle of 75%), it is not readily perceptible.

Accordingly, as shown in FIGS. 1A and 1B, for a system without adaptive frequency control, at relatively low light output levels and/or for a relatively low rate of change of a dimming control input, the light output level may include perceptible flicker, due at least in part to properties of the switching power converter, as described herein. This unstable light output may be mitigated. For example, increasing the power converter switching frequency so that the switching period corresponds to a minimum change in the ON time of the PWM dimming signal may reduce and/or eliminate this unstable light output. This may enable the switching converter to more accurately follow discrete, relatively small changes in the ON time of the PWM dimming signal and thereby provide a smooth transition in the light output. In another example, e.g., at very low steady state light levels, synchronizing the power converter switching cycle with the dimming signal PWM pulse and making the PWM pulse width an integral multiple of the power converter switching period may reduce and/or eliminate the associated oscillation/instability in perceived light output.

Increasing switching frequency may increase losses in the converter. Therefore, higher converter switching frequencies may be used during fading (dimming) alone, e.g., in the fading (dimming) region 120 of FIG. 1A, and/or a very low light output levels. This may enable higher quality deep dimming and/or fading performance while maintaining relatively high efficiency and relatively low losses in power converter and/or LED drivers.

Figure 2:
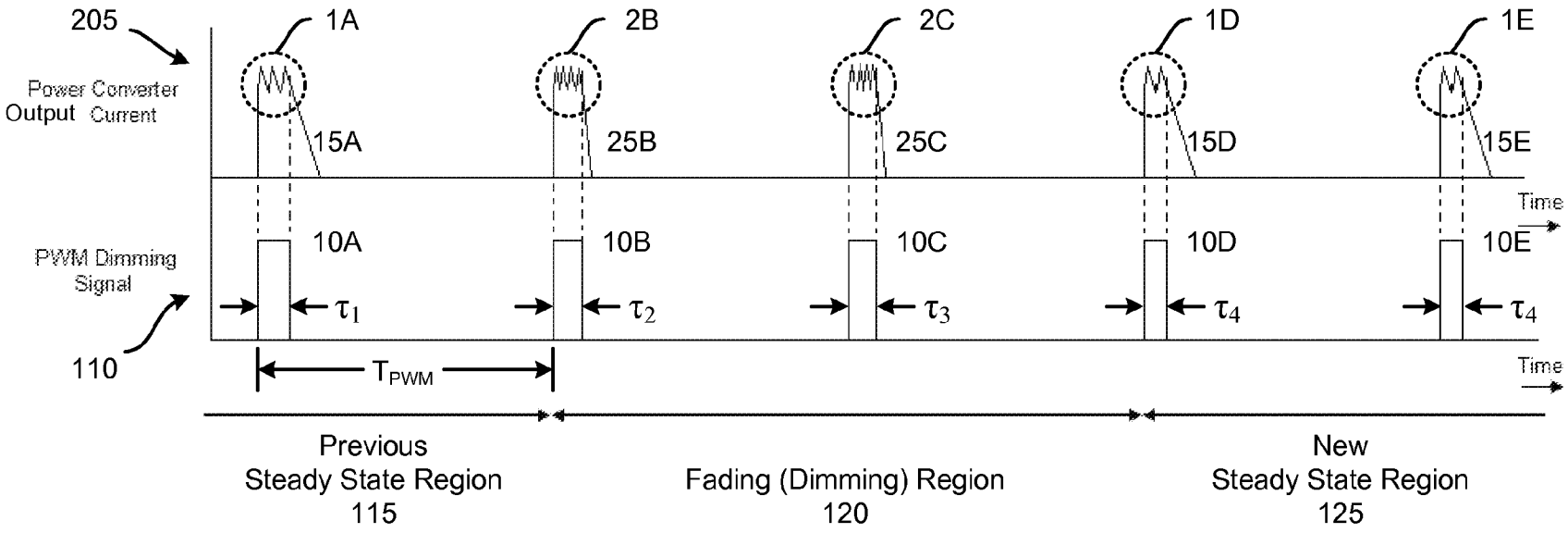
FIG. 2 show a schematic drawing of a representative waveform of output current with adaptive frequency control of a switching converter, which may deliver stable light output during fading/dimming, according to embodiments described herein.

FIG. 2 shows plots of a switching power converter output current waveform 205 and the PWM dimming signal 110, for an embodiment as disclosed herein. Similar to FIGS. 1A and 1B, the plots are simplified and are meant for illustration only. Further, elements in FIG. 2 with reference designators the same as elements in FIG. 1A, correspond to like elements. For example, the output pulse 15A and the PWM pulse 10A in the previous steady state region 115 are the same in both FIG. 1A and FIG. 2. Similarly, the output pulses 15D, 15E and the PWM pulses 10D, 10E in the new steady state region 125 are the same in both FIG. 1A and FIG. 2. The PWM pulses 10B, 10C in the fading (dimming) region 120 are the same in both FIG. 1A and FIG. 2.

In the fading (dimming) region 120, using control circuitry consistent with the present disclosure, the switching frequency of the power converter may be increased. In the previous steady state region 115 and the new steady state region 125, the switching frequency may be a nominal switching frequency, $f_{sw_nom}$, with corresponding nominal switching period, $T_{sw_nom}$. In the fading (dimming) region 120, the switching frequency may be increased to a dimming switching frequency, $f_{sw_dim}$, with a corresponding dimming switching period, $T_{sw_dim}$. For example, the nominal switching frequency may be 80 kHz and the dimming switching frequency may be 250 kHz or greater. The switching frequency may be increased in response to detecting a change in a dimming control input, as described herein. The switching frequency may be increased so that a whole number multiple of the dimming switching period ($T_{sw_dim}$) corresponds to PWM pulse width. For example, the switching frequency may be increased so that an integral multiple of the dimming switching period, $T_{sw_dim}$, corresponds to a minimum change in PWM pulse width ($\Delta\tau_{min}$). For example, in the fading (dimming) region 120, the pulse width, $\tau_2$, of the PWM pulse 10B may correspond to a ripple 2B duration of the output pulse 25B and the pulse width, $\tau_3$, of the PWM pulse 10C may correspond to a ripple 2C duration of the output pulse 25C. The ripple 2B duration may be $n*T_{sw_dim}$ and the ripple 2C duration may be $(n-r)*T_{sw_dim}$, where r is a whole number and is less than n. In other words, by increasing the switching frequency and correspondingly decreasing the switching period from $T_{sw_nom}$ to $T_{sw_dim}$, the pulse widths, $\tau_2$ and $\tau_3$, of both the PWM pulses 10B and 10C may be integral multiples of the dimming switching period $T_{sw_dim}$. As a result, a perceptible flicker in the light output level of the LED module as an amount of dimming is changed may be eliminated so that the light output level may change in a continuous manner.

In the new steady state region 125, the switching frequency may be returned to the nominal switching frequency, $f_{sw_nom}$. As described herein, $f_{sw_nom}$ maybe a lower and more efficient switching frequency for the power converter than the dimming switching frequency, $f_{sw_dim}$. In the new steady state region 125, the durations of the ripples 1D, 1E of the output pulses 15D, 15E may correspond to a lesser integral multiple (e.g., m−1) of the nominal switching period, $T_{sw_nom}$ than the integral multiple (e.g., m) of the previous steady state region 115.

In some embodiments, the unstable light output during dimming (i.e., fading) may be mitigated by adaptively reducing the frequency of the PWM dimming signal, e.g., by decreasing the PWM frequency, $f_{PWM}$, from 200 Hz to 150 Hz. Decreasing the PWM frequency increases the PWM period. The pulse width may correspond to an integral number of switching periods of the power converter. The PWM frequency may be decreased so that the duty cycle corresponds to a dimming control input.

Figure 3:
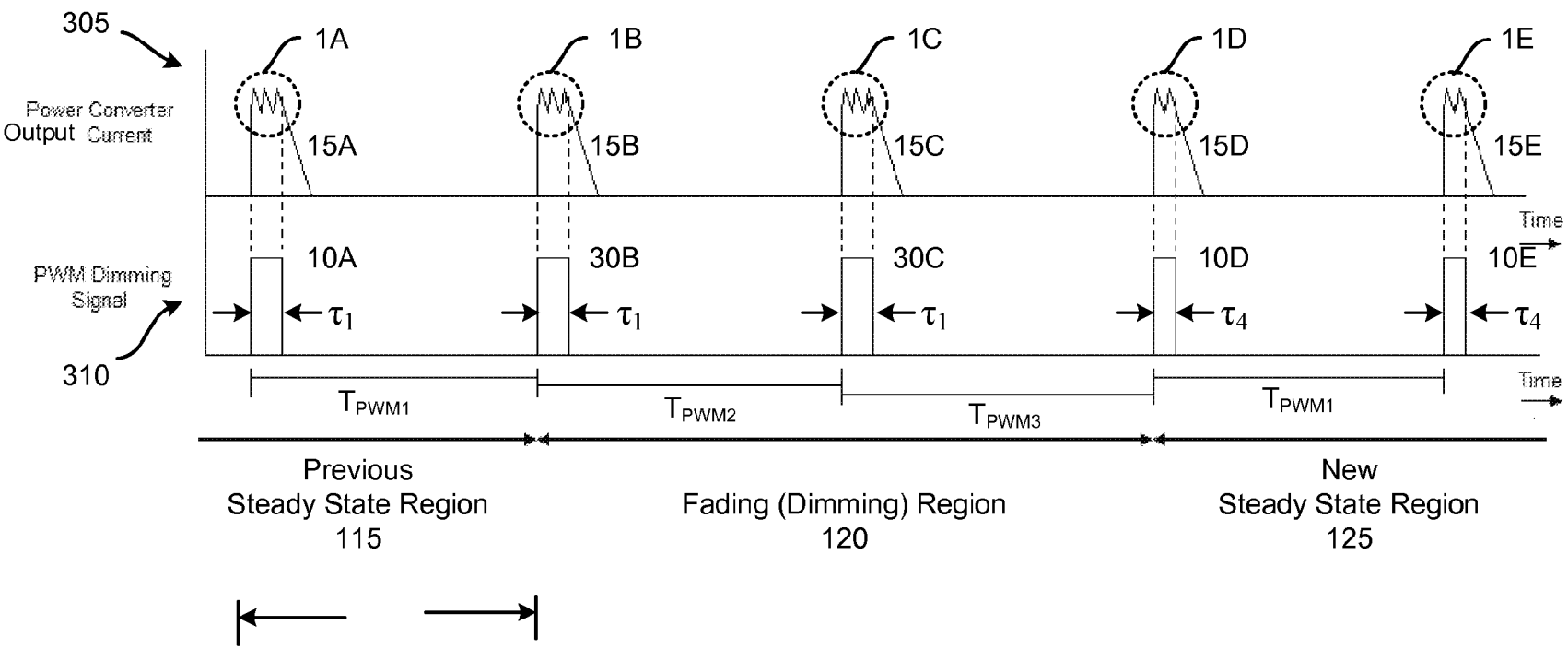
FIG. 3 shows a schematic drawing of a representative waveform of output current with adaptive frequency control of a PWM dimming signal, which may deliver stable light output during fading/dimming, according to embodiments described herein.

FIG. 3 shows plots of a switching power converter output current waveform 305 and a PWM dimming signal 310. Similar to FIGS. 1A, 1B and FIG. 2, the plots are simplified and are meant for illustration only. Further, elements in FIG. 3 with reference designators the same as elements in FIG. 1A correspond to like elements. For example, the output pulses 15A, 15B, 15C, 15D, 15E are the same in both FIG. 1A and FIG. 3. Similarly, the PWM pulse 10A in the previous steady state region 115 and the PWM pulses 10D, 10E in the new steady state region 125 are the same in both FIG. 1A and FIG. 3. The output pulse periods (i.e., time between rising edges of the output pulses) may be different in FIG. 3 than the output pulse periods of FIG. 1A. The output pulse periods in FIG. 1A may not change in the previous steady state region 115, the fading (dimming) region 120, and the new steady state region 125, while the output pulse periods in FIG. 3 may change over the previous steady state region 115, the fading (dimming) region 120, and the new steady state region 125.

In the fading (dimming) region 120, using control circuitry consistent with the present disclosure, the PWM period may be increased. In the previous steady state region 115 and the new steady state region 125, the PWM period may correspond to a nominal PWM period, $T_{PWM1}$. In the fading (dimming) region 120, the duration of the PWM period may be increased (i.e., the PWM frequency may be decreased) in response to a change in a dimming control input. The PWM pulse width, $\tau$, may be maintained at $\tau_1$, the same pulse width as in the previous steady state region 115. The PWM pulse width, $\tau_1$, may correspond to an integral multiple of the nominal switching period of the power converter, $T_{sw_nom}$. In order to adjust the light output level (e.g., to reduce the light output level) in response to a changing dimming control input, the PWM period $T_{PWM}$ may be increased so that the duty cycle ($\tau/T_{PWM}$) corresponds to the changing dimming control input. For example, the PWM dimming period may be increased from $T_{PWM1}$ to $T_{PWM2}$ then from $T_{PWM2}$ to $T_{PWM3}$, in the fading (dimming) region 120, where $T_{PWM3}$ is greater than $T_{PWM2}$ and $T_{PWM2}$ is greater than $T_{PWM1}$. For example, the nominal PWM period may correspond to a PWM frequency of 200 Hz. The PWM period may be increased to correspond to a PWM frequency of 150 Hz. At the end of the fading (dimming) period 120, for improved steady state light output, the PWM frequency may be increased so that the PWM period of the new steady state region 125 corresponds to the PWM period of the previous steady state region, i.e., $T_{PWM1}$. The PWM pulse width may be decreased correspondingly to maintain the final light output level of the new steady state region 125. The PWM pulse width may correspond to an integral number of switching periods, e.g., $(m-1)*T_{sw_nom}$.

The embodiments described in connection with FIG. 2 and FIG. 3 are configured to mitigate instabilities that may be perceptible to a human eye. The switching frequency of the power converter may be increased and/or the PWM frequency may be decreased. As a result, the pulse width of the PWM dimming signal may correspond to an integral number of switching periods of the switching converter, before, during and after a dimming transition. In some embodiments, the switching frequency may be synchronized with the PWM frequency so that the rising and/or falling edges of the PWM pulses correspond to a beginning and/or an end of a cycle of the switching waveform.

Figure 4:
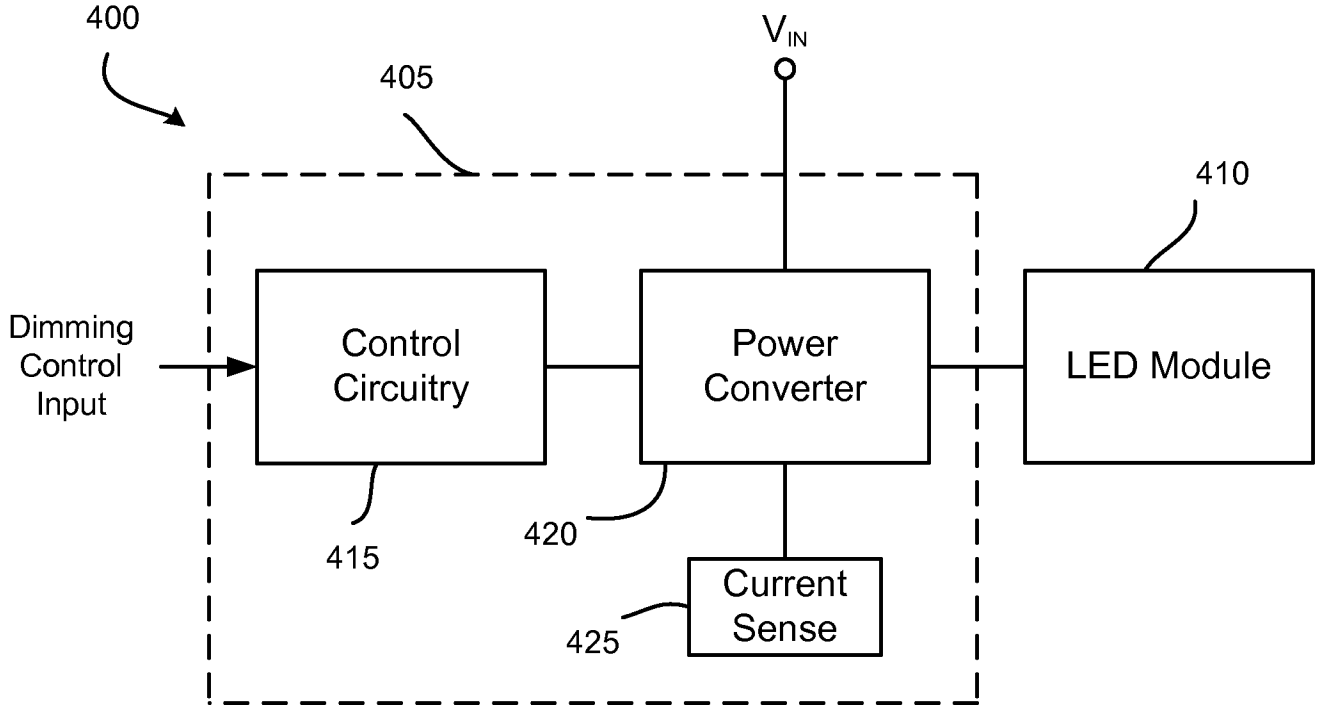
FIG. 4 shows a block diagram of a power converter with adaptive frequency control according to embodiments described herein.

FIG. 4 shows a system 400 configured to adapt a switching frequency of a switching power converter and/or a frequency of a PWM dimming signal to minimize and/or eliminate instability in light output at relatively low light output levels and/or a relatively low rate of change of a dimming control input. The system 400 includes a light dimming apparatus 405 and an LED module 410. The LED module 410 may include at least one solid state light source (not shown), such as but not limited to an LED. The light dimming apparatus 405 includes a control circuitry 415, a power converter 420, and a current sense circuitry 425. In some embodiments, the power converter 420 may be, but is not limited to, a switching converter configured to receive an input voltage, $V_{IN}$, and to convert the input voltage $V_{IN}$ to an output voltage. The power converter 420 may thus be configured to switch output current to the LED module 410 to energize the at least one solid state light source within the LED module and cause the at least one solid state light source to emit light. For example, the input voltage may be 450 VDC and the output voltage may be 107 VDC with a constant current of 350 mA. The current sense circuitry 425 provides current feedback to the power converter 420 and/or the control circuitry 415. The current feedback may, in some embodiments, represent a current in the LED module. The power converter 420 and/or the control circuitry 415 regulate the output current of the power converter 420, based at least in part on the current feedback from the current sense circuitry 425, e.g. to provide a constant current supply to the LED module 410.

The control circuitry 415 operates the power converter 420 to generate the output voltage at the constant current. The control circuitry 415 may, in some embodiments, be configured to receive a dimming control input and to control the power converter in response to the received dimming control input. The control circuitry 415 may, in some embodiments, be configured to adjust at least one of the PWM period and the switching period in response to a change in the dimming control input, as described herein. For example, the dimming control input may represent a desired dimming level of the LED module 410. In other words, the dimming control input may represent a desired light output level of the LED module 410. The control circuitry 415 may then provide a PWM dimming signal having a duty cycle corresponding to the desired light output level, and may control the power converter 420 to adjust the switching frequency of the power converter so that the pulse width of the PWM dimming signal is a whole number multiple of the switching period, as described herein. The control circuitry 415 may synchronize the switching frequency of the power converter to the PWM frequency of the PWM dimming signal.

In some embodiments, the control circuitry 415 includes, for example but not limited to, singly or in any combination, hardwired circuitry, programmable circuitry, state machine circuitry, and/or firmware that stores instructions executed by programmable circuitry. The control circuitry 415 may thus include discrete components and/or integrated circuits that may be application-specific and/or off-the-shelf. Further, the control circuitry 415 may, in some embodiments, include a microcontroller, microprocessor, processor, or other processing element that is separate and distinct from, but otherwise connected to, memory and/or a memory device, either directly or indirectly, using any known type of connection (for example, but not limited to, wired, wireless, via a network, etc.).

Figure 5:
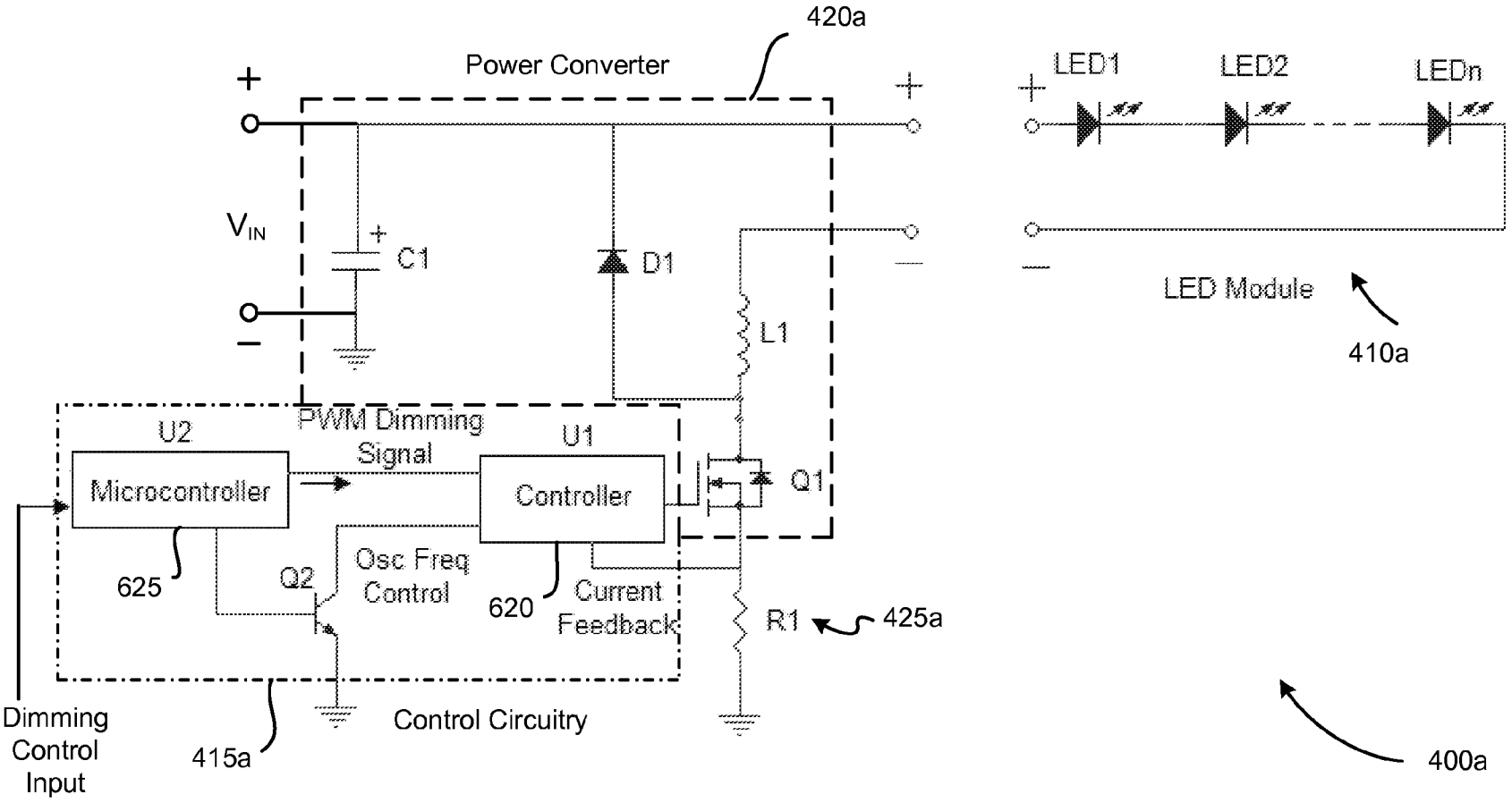
FIG. 5 shows a schematic circuit diagram of another embodiment of a power converter with adaptive frequency control.

FIG. 5 is a schematic circuit diagram illustrating a system 400*a* that is configured to adjust at least one of the PWM period and the switching period of a power converter, as described herein. The system 400*a* includes an LED module 410*a* and a light dimming apparatus that includes a power converter 420*a*, current sense circuitry 425*a*, and a control circuitry 415*a*. The LED module 410*a* includes a plurality of LEDs coupled in series, though in other embodiments, other solid state light sources may be used in place of some or all of the LEDs. For example, in some embodiments, the LED module 410*a* may include thirty three series-connected LEDs. The power converter 420*a* is a buck converter configured to step down the input voltage $V_{IN}$ to an output voltage less than the input voltage. For example, the buck converter 420*a* may include a capacitor C1, a diode D1, an inductor L1, and a transistor Q1. The transistor Q1 may be, but is not limited to, a MOSFET (metal-oxide semiconductor field effect transistor), such as an enhancement mode, n-channel MOSFET, and may be configured to operate at voltages up to 600 VDC and at currents up to 5 to 8 A.

The power converter 420*a* provides a constant output current. In some embodiments, the power converter 420*a* may receive an input voltage of 450 VDC and may provide an output voltage of 107 VDC at a constant current of 350 mA. The current sense circuitry 425*a*, e.g., a sense resistor R1, is configured to provide current feedback to the control circuitry 415*a* to facilitate maintaining a desired output current, i.e., to facilitate current regulation. In some embodiments, the current may be sensed using the inductor L1. The control circuitry 415*a* may include a controller 620, a microcontroller 625, and a transistor Q2. The controller 620 may be, but is not limited to, a conventional controller for a switching power converter. The controller 620 may drive the transistor Q1 of the power converter 420 at the switching frequency to generate the desired output voltage and output current. The controller 620 may receive an oscillator frequency control input from the microcontroller 625. An output of the microcontroller 625 corresponding to the oscillator frequency control input may be transformed by the transistor Q2 to a current and/or voltage compatible with the controller 620. For example, the transistor Q2 may be a bipolar junction transistor (BJT). The oscillator frequency control input may correspond to a desired switching frequency of the power converter 420 (and the transistor Q1). The controller 620 may be configured to control the switching frequency based, at least in part, on the oscillator frequency control input.

The controller 620 may be configured to sense the output current using the sense resistor R1 and to use the sensed current for current regulation. The controller 620 is configured to receive a PWM dimming signal from the microcontroller 625 corresponding to the dimming control input. The dimming control input corresponds to a desired light output level. The microcontroller 625 may be configured to receive the dimming control input and to provide the PWM dimming signal and/or an output corresponding to the oscillator frequency control to the controller 620. The microcontroller 625 may be configured to detect a change in the dimming control input. In response to the change, the microcontroller 625 may be configured to adjust at least one of the PWM dimming signal and the oscillator frequency control. For example, the PWM dimming signal may enable the controller 620 during the PWM pulse (ON time) and may disable the controller 620 during the OFF time to halt switching (when the current switching cycle completes, as described herein). During dimming, the microcontroller may adjust the duty cycle of the PWM dimming signal and/or adjust the oscillator frequency control to cause the controller 620 to adjust the switching frequency of the power converter, as described herein.

Figure 6:
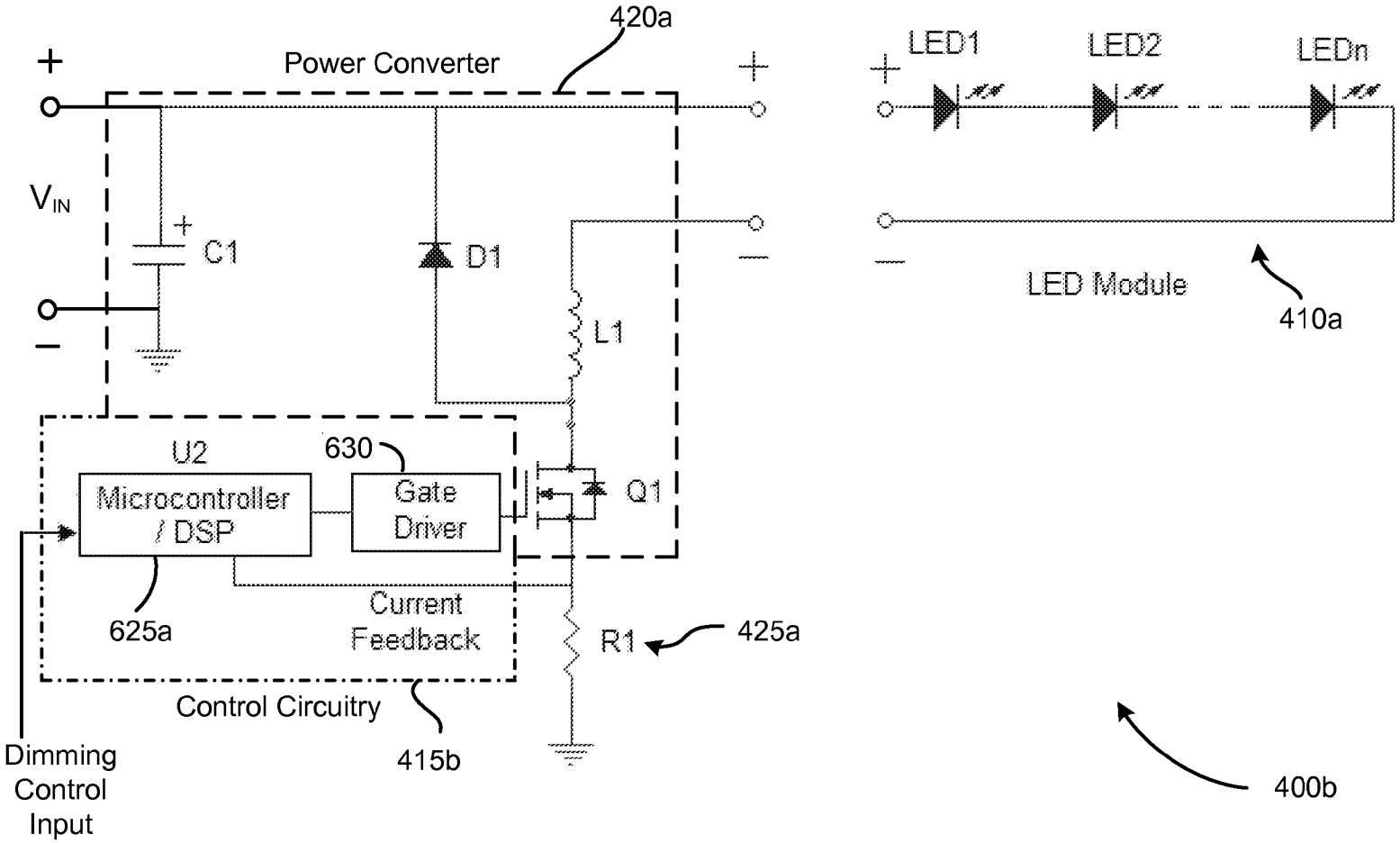
FIG. 6 shows a schematic circuit diagram of another embodiment of a power converter with adaptive frequency control.

FIG. 6 is a schematic circuit diagram illustrating a system 400*b* that adjusts at least one of a PWM period and the switching period of a power converter, as described herein. The system 400*b* includes an LED module 410*a*, as described above, and a light dimming apparatus that includes a power converter 420*a*, a current sense circuitry 425*a*, and a control circuitry 415*b*. The control circuitry 415*b* receives a dimming control input and controls the power converter (e.g., switching frequency and/or PWM period) based, at least in part, on the dimming control input. The control circuitry 415*b* may, in some embodiments, include a gate driver 630 and a microcontroller 625*a*, as shown in FIG. 6. The gate driver 630 may be configured to drive the transistor Q1 based on an input from the microcontroller 625*a*. The microcontroller 625*a* may be configured to sense a current in the current sense circuitry, i.e. a resistor R1 in FIG. 6, and to regulate the output current of the power converter 420*a* based, at least in part, on the sensed current. The microcontroller 625*a* may be configured to receive the dimming control input and to control the gate driver 630 based, at least in part, on the dimming control input, e.g. using digital signal processing (DSP) circuitry. In general, DSP circuitry involves processing signals using one or more application specific integrated circuits (ASICS) and/or special purpose processors configured to perform specific instruction sequences, e.g. directly and/or under the control of software instructions. The gate driver 630 may be configured to drive the transistor Q1 based, at least in part, on an input from the microcontroller 625*a*. The microcontroller 625*a* may then control the switching frequency of the power converter 420*a*, the PWM pulse width (e.g., the ON time of the switching converter 420*a*) and/or the PWM period (e.g., the OFF time of the switching converter 420) by controlling the gate driver 630.

Using a microcontroller with DSP circuitry (i.e., the microcontroller 625*a* in FIG. 6) may provide more effective and/or more efficient control of the power converter 420*a* during dimming. For example, the switching frequency of the power converter and the PWM dimming signal (internally created in the microcontroller 625*a*) may be synchronized more accurately. A combination of discrete components may also be used in place of a microcontroller with DSP circuitry to achieve adaptive frequency control, without departing from the scope of the invention as disclosed herein.

Figure 7:
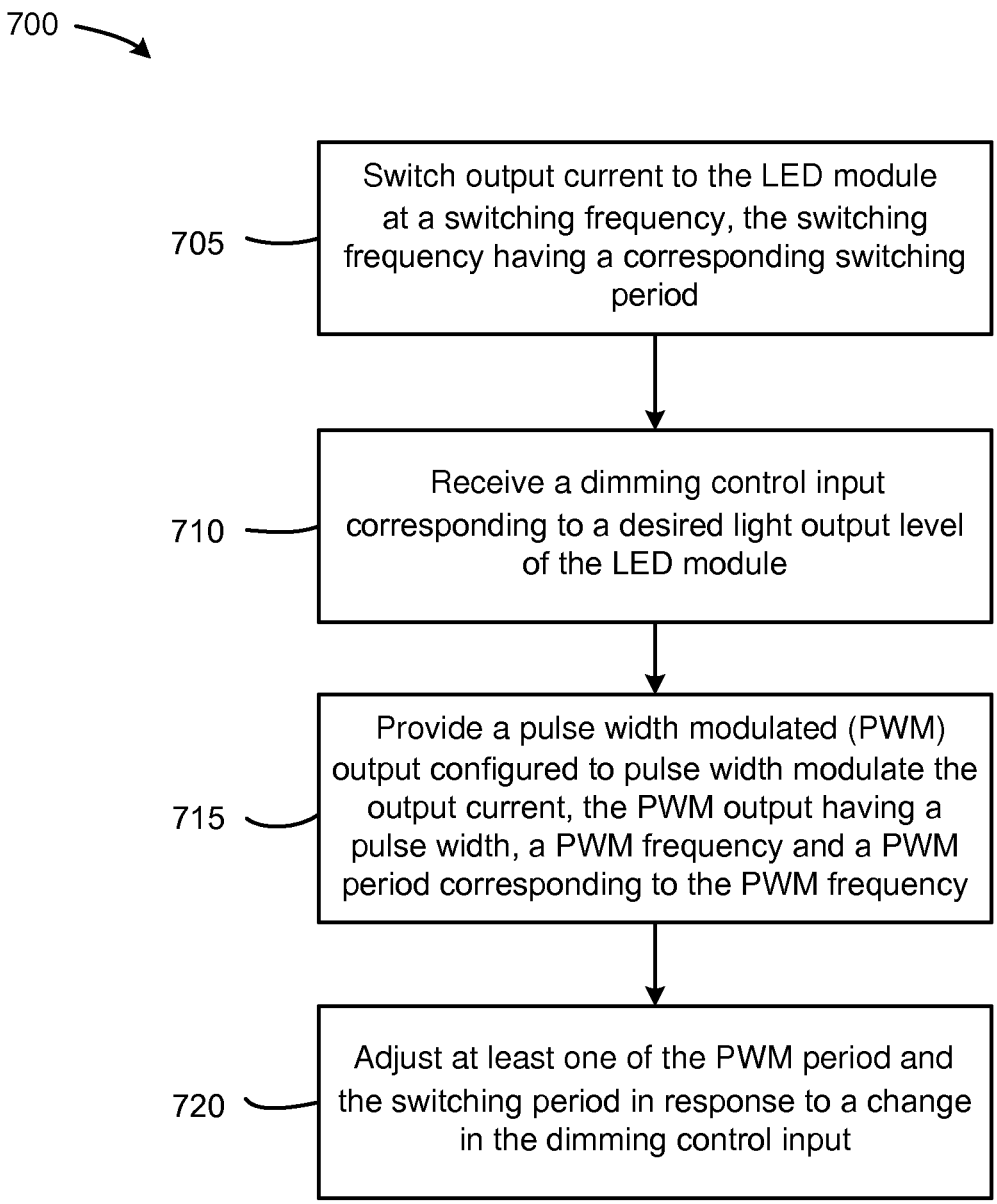
FIG. 7 is a block flow diagram of a method of changing a light output level of an LED module, according to embodiments described herein.

A flowchart of a method 700 of dimming a light output level of an LED module is illustrated in FIG. 7. The rectangular elements are herein denoted "processing blocks" and represent instructions or groups of instructions. Alternatively, the processing blocks represent steps performed by functionally equivalent circuits, such as but not limited to a digital signal processor circuit, an application specific integrated circuit (ASIC), or a microcontroller. The flowchart does not depict the syntax of any particular programming language. Rather, the flowchart illustrates the functional information one of ordinary skill in the art requires to fabricate circuits or to generate instructions to perform the processing required in accordance with the present invention. It should be noted that many routine program elements, such as initialization of loops and variables and the use of temporary variables are not shown. It will be appreciated by those of ordinary skill in the art that unless otherwise indicated herein, the particular sequence of steps described is illustrative only and may be varied without departing from the spirit of the invention. Thus, unless otherwise stated, the steps described below are unordered, meaning that, when possible, the steps may be performed in any convenient or desirable order. In addition, the method 700 may, and in some embodiments does, include subcombinations of the steps depicted in FIG. 7 and/or additional operations described herein.

Output current is switched to the LED module at a switching frequency, step 705. The switching frequency has a corresponding switching period, e.g. using a switching mode power converter. Then, a dimming control input is received, step 710. The dimming control input corresponds to a desired light output level of the LED module. Next, a pulse width modulation (PWM) output is provided, step 715. The PWM output is configured to pulse width modulate the output current. The PWM output has a pulse width, a PWM frequency, and a PWM period corresponding to the PWM frequency. Finally, at least one of the PWM period and the switching period is adjusted in response to a change in the dimming control input, step 720.

The methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, magnetic disk, internal hard drive, external hard drive, memory stick, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer(s), workstation(s) (e.g., Sun, HP), personal digital assistant(s) (PDA(s)), handheld device(s) such as cellular telephone(s) or smart cellphone(s), laptop(s), handheld computer(s), or another device(s) capable of being integrated with a processor(s) that may operate as provided herein. Accordingly, the devices provided herein are not exhaustive and are provided for illustration and not limitation.

References to "a microprocessor" and "a processor", or "the microprocessor" and "the processor," may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A light output control apparatus, comprising:

a switched mode power converter configured to switch output current to a light emitting diode (LED) module at a switching frequency, the switching frequency having a corresponding switching period, the LED module comprising at least one LED lighting element; and control circuitry, wherein the control circuitry is configured to receive a dimming control input, the dimming control input corresponding to a desired light output level of the LED module, to provide a pulse width modulation (PWM) output configured to pulse width modulate the output current, wherein the PWM output has a pulse width, a PWM frequency, and a PWM period corresponding to the PWM frequency, and to adjust at least one of the PWM period and the switching period in response to a change in the dimming control input and to adjust the at least one of the PWM period and the switching period so that the PWM pulse width is an integral multiple of the switching period, such that a light output level of the LED module is appropriately changed.

2. The light output control apparatus of claim 1, wherein the control circuitry is further configured to increase the switching frequency in response to the change in the dimming control input.

3. The light output control apparatus of claim 2, wherein a maximum switching frequency corresponds to a minimum PWM pulse width.

4. The light output control apparatus of claim 1, wherein the control circuitry is further configured to increase the PWM period in response to the dimming control input.

5. The light output control apparatus of claim 1, wherein the control circuitry is further configured to synchronize the PWM output and the switching of the power converter.

6. The light output control apparatus of claim 1, wherein the control circuitry is further configured to adjust the at least one of the PWM period and the switching period when the desired light output level is below a threshold.

7. A system, comprising:

a light emitting diode (LED) module comprising at least one LED lighting element;

a switched mode power converter configured to switch output current to the LED module at a switching frequency, the switching frequency having a corresponding switching period; and control circuitry configured to receive a dimming control input corresponding to a desired light output level of the LED module, to provide a pulse width modulation (PWM) output configured to pulse width modulate the output current, wherein the PWM output has a pulse width, a PWM frequency and a PWM period corresponding to the PWM frequency, and to adjust at least one of the PWM period and the switching period in response to a change in the dimming control input, and to increase the switching frequency in response to the change in the dimming control input, and to adjust the at least one of the PWM period and the switching period so that the PWM pulse width is an integral multiple of the switching period.

8. The system of claim 7, wherein a maximum switching frequency corresponds to a minimum PWM pulse width.

9. The system of claim 7, wherein the control circuitry is further configured to increase the PWM period in response to the dimming control input.

10. The system of claim 7, wherein the control circuitry is further configured to synchronize the PWM output and the switching of the power converter.

11. The system of claim 7, wherein the control circuitry is further configured to adjust the at least one of the PWM period and the switching period when the desired light output level is below a threshold.

12. A method of changing a light output level of a light emitting diode (LED) module, the method comprising:

switching an output current to the LED module at a switching frequency, the switching frequency having a corresponding switching period;

receiving a dimming control input corresponding to a desired light output level of the LED module;

providing a pulse width modulation (PWM) output configured to pulse width modulate the output current, wherein the PWM output has a pulse width, a PWM frequency and a PWM period corresponding to the PWM frequency; and adjusting at least one of the PWM period and the switching period in response to a change in the dimming control input so that the PWM pulse width is an integral multiple of the switching period, such that the light output level of the LED module is appropriately changed.

13. The method of claim 12, wherein adjusting comprises:

increasing the switching frequency in response to the change in the dimming control input.

14. The method of claim 13, wherein providing comprises:

providing a pulse width modulation (PWM) output configured to pulse width modulate the output current, wherein the PWM output has a pulse width, a PWM frequency and a PWM period corresponding to the PWM frequency, and wherein a maximum switching frequency corresponds to a minimum PWM pulse width.

15. The method of claim 12, wherein adjusting comprises:

increasing the PWM period in response to the dimming control input.

16. The method of claim 12, further comprising:

synchronizing the PWM output and the switching of a power converter connected to the LED module.

17. The method of claim 12, further comprising:

determining that the desired light output level is below a threshold; and in response, adjusting at least one of the PWM period and the switching period.

* * * * *